US008797344B2

(12) United States Patent
Han et al.

(10) Patent No.: US 8,797,344 B2
(45) Date of Patent: Aug. 5, 2014

(54) MEMORY STRUCTURES FOR IMAGE PROCESSING

(75) Inventors: SeokJin Han, Cupertino, CA (US); Thomas Lloyd Credelle, Morgan Hill, CA (US)

(73) Assignee: Samsung Display Co., Ltd. (KR)

( * ) Notice: Subject to any disclaimer, the term of this patent is extended or adjusted under 35 U.S.C. 154(b) by 1878 days.

(21) Appl. No.: 12/090,354

(22) PCT Filed: Oct. 13, 2006

(86) PCT No.: PCT/US2006/040269

§ 371 (c)(1), (2), (4) Date: Aug. 5, 2009

(87) PCT Pub. No.: WO2007/047534

PCT Pub. Date: Apr. 26, 2007

(65) Prior Publication Data

US 2010/0026704 A1 Feb. 4, 2010

Related U.S. Application Data

(60) Provisional application No. 60/727,079, filed on Oct. 14, 2005.

(51) Int. Cl.
*G09G 5/02* (2006.01)
*G09G 5/36* (2006.01)

(52) U.S. Cl.
USPC ..... 345/590; 345/560; 345/604

(58) Field of Classification Search
USPC ..... 345/530, 536, 560, 590, 604
See application file for complete search history.

(56) References Cited

U.S. PATENT DOCUMENTS

| | | | | |
|---|---|---|---|---|
| 5,726,682 | A * | 3/1998 | Lum et al. | 345/604 |
| 7,084,923 | B2 * | 8/2006 | Brown Elliott et al. | 348/441 |
| 7,199,897 | B2 * | 4/2007 | Nomizu | 358/1.18 |
| 7,248,268 | B2 * | 7/2007 | Brown Elliott et al. | 345/613 |
| 7,777,914 | B2 * | 8/2010 | Seko et al. | 358/1.9 |
| 7,907,154 | B2 * | 3/2011 | Rykowski et al. | 345/690 |
| 2002/0060799 | A1 | 5/2002 | Fukasawa | |
| 2004/0080479 | A1 * | 4/2004 | Credelle | 345/88 |
| 2004/0113876 | A1 | 6/2004 | Motomura | |
| 2005/0083341 | A1 | 4/2005 | Higgins et al. | |
| 2005/0225548 | A1 | 10/2005 | Han et al. | |
| 2005/0225574 | A1 | 10/2005 | Brown Elliott et al. | |

FOREIGN PATENT DOCUMENTS

| | | | |
|---|---|---|---|
| JP | 2001-218079 | A | 8/2001 |
| JP | 2004-246325 | A | 9/2004 |
| TW | 500942 | B | 9/2002 |
| TW | 511061 | B | 11/2002 |
| WO | 03/001499 | A1 | 1/2003 |

* cited by examiner

*Primary Examiner* — Joni Richer
(74) *Attorney, Agent, or Firm* — Innovation Counsel LLP

(57) ABSTRACT

A display system comprises line buffer memory that stores input image data in a first color space, and a plurality of gamut mapping modules that accept the input image data from the line buffer memory and performs a gamut mapping operation to produce mapped image data specified in a second color space. The system also includes a subpixel rendering module that renders the image data specified in the second color space for display on a display panel substantially comprised of a particular subpixel repeating group. The system architecture utilizes a plurality of gamut mapping modules which in turn allows for a reduction in the size of line buffer memory needed for the subpixel rendering operation.

21 Claims, 6 Drawing Sheets

MEMORY STRUCTURES FOR IMAGE PROCESSING

CROSS REFERENCE TO RELATED APPLICATIONS

This application claims the benefit of U.S. Provisional Application 60/727,079 entitled MEMORY STRUCTURES FOR IMAGE PROCESSING, filed on Oct. 14, 2005, which is hereby incorporated by reference herein in its entirety.

TECHNICAL FIELD

The present application relates to various embodiments of image display systems and image processing methods that utilize a plurality of line buffer memory with a plurality of gamut mapping modules.

BACKGROUND

In commonly owned United States patents and patent applications: (1) United States Patent Application Publication Number 2002/0015110 entitled "ARRANGEMENT OF COLOR PIXELS FOR FULL COLOR IMAGING DEVICES WITH SIMPLIFIED ADDRESSING," filed Jul. 25, 2001, and now issued as U.S. Pat. No. 6,903,754; (2) United States Patent Application Publication Number 2004/0046714 ("the '714 application") (Ser. No. 10/024,326), entitled "IMPROVEMENTS TO COLOR FLAT PANEL DISPLAY SUB-PIXEL ARRANGEMENTS AND LAYOUTS," filed Dec. 14, 2001; (3) United States Patent Application Publication Number 2003/0128225 ("the '225 application") (Ser. No. 10/278,353), entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (4) United States Patent Application Publication Number 2003/0128179 ("the '179 application") (Ser. No. 10/278,352), entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (5) United States Patent Application Publication Number 2004/0051724 ("the '724 application") (Ser. No. 10/243,094), entitled "IMPROVED FOUR COLOR ARRANGEMENTS AND EMITTERS FOR SUB-PIXEL RENDERING," filed Sep. 13, 2002; (6) United States Patent Application Publication Number 2003/0117423 ("the '423 application") (Ser. No. 10/278,328), entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (7) United States Patent Application Publication Number 2003/0090581 ("the '581 application") (Ser. No. 10/278,393), entitled "COLOR DISPLAY HAVING HORIZONTAL SUB-PIXEL ARRANGEMENTS AND LAYOUTS," filed Oct. 22, 2002; (8) United States Patent Application Publication Number 2004/0080479 ("the '479 application") (Ser. No. 10/347,001), entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003; (9) United States Patent Application Publication Number 2004/0140983 ("the '983 application") (Ser. No. 10/349,768), entitled "SYSTEMS AND METHODS OF SUBPIXEL RENDERING IMPLEMENTED ON DISPLAY PANELS," filed Jan. 22, 2003, each of which is herein incorporated by reference in its entirety, novel sub-pixel arrangements are disclosed for improving the cost/performance curves for image display devices.

For certain subpixel repeating groups having an even number of subpixels in a horizontal direction, the following systems and techniques to affect improvements, e.g. proper dot inversion schemes and other improvements, are disclosed and are herein incorporated by reference in their entirety: (1) United States Patent Application Publication Number 2004/0246280 ("the '280 application") (Ser. No. 10/456,839), entitled "IMAGE DEGRADATION CORRECTION IN NOVEL LIQUID CRYSTAL DISPLAYS," filed Jun. 6, 2003; (2) United States Patent Application Publication Number 2004/0246213 ("the '213 application") (Ser. No. 10/455,925), entitled "DISPLAY PANEL HAVING CROSSOVER CONNECTIONS EFFECTING DOT INVERSION," filed Jun. 6, 2003; (3) United States Patent Application Publication Number 2004/0246381 ("the '381 application") (Ser. No. 10/455,931), entitled "SYSTEM AND METHOD OF PERFORMING DOT INVERSION WITH STANDARD DRIVERS AND BACKPLANE ON NOVEL DISPLAY PANEL LAYOUTS," filed Jun. 6, 2003; (4) United States Patent Application Publication Number 2004/0246278 ("the '278 application") (Ser. No. 10/455,927), entitled "SYSTEM AND METHOD FOR COMPENSATING FOR VISUAL EFFECTS UPON PANELS HAVING FIXED PATTERN NOISE WITH REDUCED QUANTIZATION ERROR," filed Jun. 6, 2003; (5) United States Patent Application Publication Number 2004/0246279 ("the '279 application") (Ser. No. 10/456,806), entitled "DOT INVERSION ON NOVEL DISPLAY PANEL LAYOUTS WITH EXTRA DRIVERS," filed Jun. 6, 2003; (6) United States Patent Application Publication Number 2004/0246404 ("the '404 application") (Ser. No. 10/456,838), entitled "LIQUID CRYSTAL DISPLAY BACKPLANE LAYOUTS AND ADDRESSING FOR NON-STANDARD SUBPIXEL ARRANGEMENTS," filed Jun. 6, 2003; (7) United States Patent Application Publication Number 2004/0246393 ("the '393 application") (Ser. No. 10/456,794), entitled "ALTERNATIVE THIN FILM TRANSISTORS FOR LIQUID CRYSTAL DISPLAYS," filed Jun. 6, 2003; (8) United States Patent Application Publication Number 2005/0083277 ("the '277 application") (Ser. No. 10/696,236), entitled "IMAGE DEGRADATION CORRECTION IN NOVEL LIQUID CRYSTAL DISPLAYS WITH SPLIT BLUE SUBPIXELS", filed Oct. 28, 2003; and (9) United States Patent Application Publication Number 2005/0212741 ("the '741 application") (Ser. No. 10/807,604), entitled "IMPROVED TRANSISTOR BACKPLANES FOR LIQUID CRYSTAL DISPLAYS COMPRISING DIFFERENT SIZED SUBPIXELS", filed Mar. 23, 2004.

These improvements are particularly pronounced when coupled with sub-pixel rendering (SPR) systems and methods further disclosed in those applications and in commonly owned United States patents and patent applications: (1) United States Patent Application Publication Number 2003/0034992 ("the '992 application") (Ser. No. 10/051,612), entitled "CONVERSION OF A SUB-PIXEL FORMAT DATA TO ANOTHER SUB-PIXEL DATA FORMAT," filed Jan. 16, 2002; (2) United States Patent Application Publication Number 2003/0103058 ("the '058 application") (Ser. No. 10/150,355), entitled "METHODS AND SYSTEMS FOR SUB-PIXEL RENDERING WITH GAMMA ADJUSTMENT," filed May 17, 2002; (3) United States Patent Application Publication Number 2003/0085906 ("the '906 application") (Ser. No. 10/215,843), entitled "METHODS AND SYSTEMS FOR SUB-PIXEL RENDERING WITH ADAPTIVE FILTERING," filed Aug. 8, 2002; (4)

United States Patent Application Publication Number 2004/0196302 ("the '302 application") (Ser. No. 10/379,767) entitled "SYSTEMS AND METHODS FOR TEMPORAL SUB-PIXEL RENDERING OF IMAGE DATA" filed Mar. 4, 2003; (5) United States Patent Application Publication Number 2004/0174380 ("the '380 application") (Ser. No. 10/379,765), entitled "SYSTEMS AND METHODS FOR MOTION ADAPTIVE FILTERING," filed Mar. 4, 2003; (6) United States Patent Application Publication Number 2004/0174375 ("the '375 application") entitled "SUB-PIXEL RENDERING SYSTEM AND METHOD FOR IMPROVED DISPLAY VIEWING ANGLES" filed Mar. 4, 2003 and now issued as U.S. Pat. No. 6,890,219; and (7) United States Patent Application Publication Number 2004/0196297 ("the '297 application") (Ser. No. 10/409,413), entitled "IMAGE DATA SET WITH EMBEDDED PRE-SUBPIXEL RENDERED IMAGE" filed Apr. 7, 2003. All of which are all hereby incorporated herein by reference in their entirety.

Improvements in gamut conversion and mapping are disclosed in commonly owned and co-pending United States patents and patent applications: (1) United States Patent Application Publication Number 2005/0083345 entitled "HUE ANGLE CALCULATION SYSTEM AND METHODS", filed Oct. 21, 2003, now issued as U.S. Pat. No. 6,890,219; (2) United States Patent Application Publication Number 2005/0083341 ("the '341 application") (Ser. No. 10/691,377), entitled "METHOD AND APPARATUS FOR CONVERTING FROM SOURCE COLOR SPACE TO RGBW TARGET COLOR SPACE", filed Oct. 21, 2003; (3) United States Patent Application Publication Number 2005/0083352 ("the '352 application.") (Ser. No. 10/691,396), entitled "METHOD AND APPARATUS FOR CONVERTING FROM A SOURCE COLOR SPACE TO A TARGET COLOR SPACE", filed Oct. 21, 2003; and (4) United States Patent Application Publication Number 2005/0083344 ("the '344 application") (Ser. No. 10/690,716), entitled "GAMUT CONVERSION SYSTEM AND METHODS" filed Oct. 21, 2003. All of which are all hereby incorporated herein by reference in their entirety.

Additional advantages have been described in (1) United States Patent Application Publication Number 2005/0099540 ("the '540 application") (Ser. No. 10/696,235), entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and (2) United States Patent Application Publication Number 2005/0088385 ("the '385 application") (Ser. No. 10/696,026), entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which are all hereby incorporated herein by reference in their entirety.

Additionally, these co-owned and co-pending applications are herein incorporated by reference in their entirety: (1) United States Patent Application Publication Number 2005/0225548 ("the '548 application") (Ser. No. 10/821,387), entitled "SYSTEM AND METHOD FOR IMPROVING SUB-PIXEL RENDERING OF IMAGE DATA IN NON-STRIPED DISPLAY SYSTEMS" filed Apr. 9, 2004; (2) United States Patent Application Publication Number 2005/0225561 ("the '561 application") Ser. No. 10/821,386), entitled "SYSTEMS AND METHODS FOR SELECTING A WHITE POINT FOR IMAGE DISPLAYS" filed Apr. 9, 2004; (3) United States Patent Application Publication Number 2005/0225574 ("the '574 application") and United States Patent Application Publication Number 20050225575 ("the '575 application") (Ser. Nos. 10/821,353 and 10/961,506) respectively,—both entitled "NOVEL SUBPIXEL LAYOUTS AND ARRANGEMENTS FOR HIGH BRIGHTNESS DISPLAYS" filed Apr. 9, 2004 and Oct. 7, 2004 respectively; (4) United States Patent Application Publication Number 2005/0225562 ("the '562 application") (Ser. No. 10/821,306), entitled "SYSTEMS AND METHODS FOR IMPROVED GAMUT MAPPING FROM ONE IMAGE DATA SET TO ANOTHER" filed Apr. 9, 2004; (5) United States Patent Application Publication Number 2005/0225563 ("the '563 application") (Ser. No. 10/821,388), entitled "IMPROVED SUBPIXEL RENDERING FILTERS FOR HIGH BRIGHTNESS SUBPIXEL LAYOUTS" filed Apr. 9, 2004; (6) United States Patent Application Publication Number [2005/0276502] ("the '502 application") (Ser. No. 10/866,447), entitled "INCREASING GAMMA ACCURACY IN QUANTIZED DISPLAY SYSTEMS" filed Jun. 10, 2004. All of which are all hereby incorporated by reference.

Additional improvements to, and embodiments of, display systems and methods of operation thereof are described in: (1) Patent Cooperation Treaty (PCT) Application No. PCT/US 06/12768, entitled "EFFICIENT MEMORY STRUCTURE FOR DISPLAY SYSTEM WITH NOVEL SUBPIXEL STRUCTURES" filed Apr. 4, 2006, and published in the United States as United States Patent Application Publication 200Y/AAAAAA ("the 'AAA application"); (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006, and published in the United States as United States Patent Application Publication 200Y/BBBBBBB ("the 'BBB application"); (3) U.S. patent application Ser. No. 11/278,675, entitled "SYSTEMS AND METHODS FOR IMPLEMENTING IMPROVED GAMUT MAPPING ALGORITHMS" filed Apr. 4, 2006, and published as United States Patent Application Publication 200Y/CCCCCCC ("the 'CCC application"); (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006, and published in the United States as United States Patent Application Publication 200Y/DDDDDDD ("the 'DDD application"); and (5) Patent Cooperation Treaty (PCT) Application No. PCT/US 06/NNNNN, entitled "MULTIPRIMARY COLOR SUBPIXEL RENDERING WITH METAMERIC FILTERING" filed on May 19, 2006 and published in the United States as United States Patent Application Publication 200Y/EEEEEEE ("the 'EEE application"). Each of these co-owned applications is also herein incorporated by reference in their entirety.

DISCLOSURE OF THE INVENTION

Technical Effect: The various embodiments of the display systems illustrated and described below have the technical effect of reducing the size of the line buffer memory needed to supply data to a subpixel rendering operation by utilizing a plurality of line buffer memory to provide data to a plurality of gamut mapping modules.

A display system comprises line buffer memory that stores input image data in a first color space, and a plurality of gamut mapping modules that accept the input image data from the line buffer memory and performs a gamut mapping operation to produce image data specified in a second color space. The system also includes a subpixel rendering module that renders the image data specified in the second color space for display on a display panel substantially comprised of a particular subpixel repeating group. The system architecture utilizes a plurality of gamut mapping modules which in turn allows for a reduction in the size of line buffer memory needed for the subpixel rendering operation.

An image processing method renders an image onto a display panel substantially comprising a subpixel repeating group. The method comprises receiving input image data specified in a first color space and indicating a portion of the image, and storing the input image data in a plurality of line buffer memory. The method further comprises performing a gamut mapping operation using the input image data stored in the plurality of line buffer memory to produce mapped image data indicating image data values in a second color space; and performing a subpixel rendering operation using the mapped image data to produce subpixel data values for rendering the portion of the image on the display panel.

BRIEF DESCRIPTION OF THE DRAWINGS

The organization and methods of operation of the image processing systems and techniques are best understood from the following description of several exemplary implementations and embodiments when read in connection with the accompanying drawings, wherein the same reference numbers are used throughout the drawings to refer to the same or like parts. The accompanying drawings are incorporated in and constitute a part of this specification.

MODES FOR CARRYING OUT THE INVENTION

Figure 1:
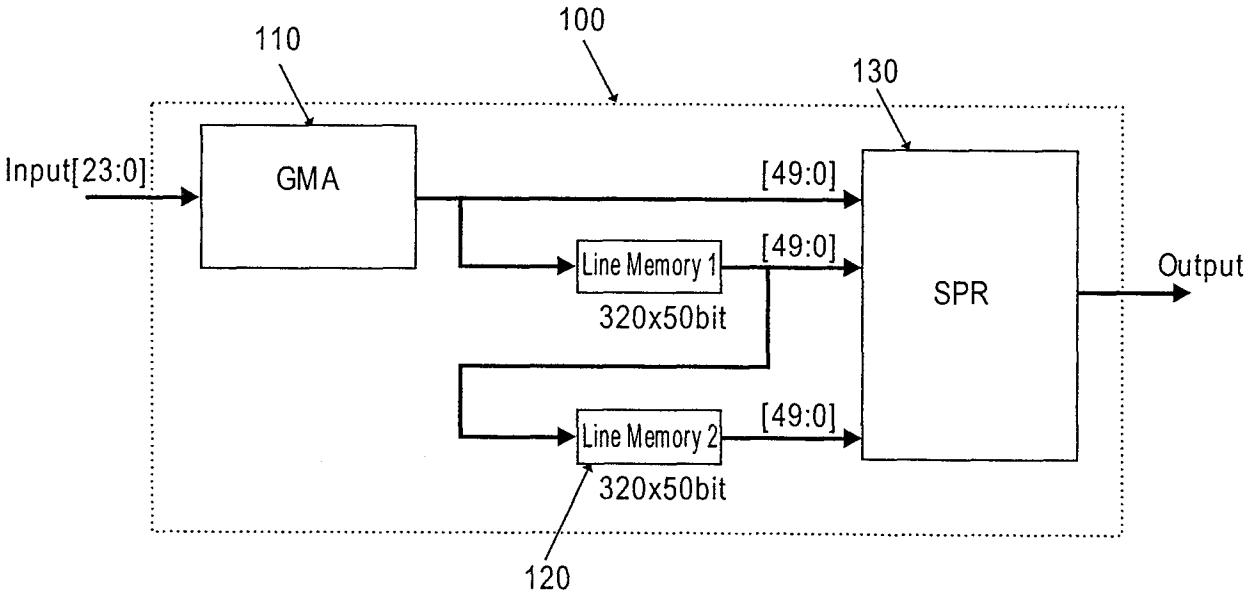
FIG. 1 (PRIOR ART)
FIG. 1 is a simplified block diagram of a portion of an image processing system or image display system showing a conventional memory structure and that includes a subpixel rendering capability for displaying subpixel rendered images.
Figure 5:
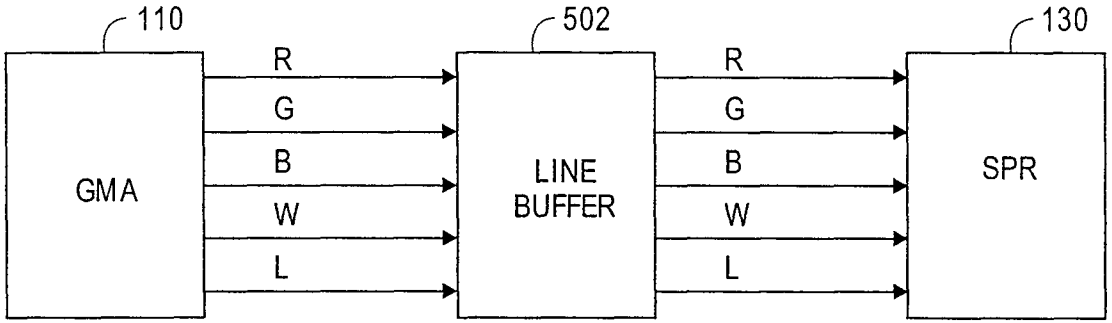
FIG. 5 (PRIOR ART)
FIG. 5 is a simplified block diagram of the portion of the image processing system or image display system of FIG. 1 depicting a memory structure in a conventional multiprimary image processing system.

FIG. 1 is a simplified block diagram of a portion 100 of the functional components of a display system that performs subpixel rendering of an input image data set for an electronic display panel (not shown) substantially comprised of a plurality of a subpixel repeating group of the type disclosed in United States Patent Application Publication Numbers 2005/0225574 and 20050225575, both of which are entitled "NOVEL SUBPIXEL LAYOUTS AND ARRANGEMENTS FOR HIGH BRIGHTNESS DISPLAYS." Typically, a gamut mapping algorithm module (GMA) 110 accepts the input image data and performs any necessary or desired gamut mapping operation upon the input image data. For example, if the input image data is conventional red, green and blue (RGB) converged input data that is to be displayed upon a display panel substantially comprising a subpixel repeating group of red, green, blue and white (i.e., clear) (RGBW) subpixels, then a mapping operation may be desirable in order to use the W primary of the display. This operation might also be desirable in any general multiprimary (having more than three primary colors) display system where input image data is mapped from the input color space to another color space with a different number of primaries in the output color space. Additionally, GMA unit 110 might be used to handle situations where input image color data might be considered to be "out of gamut" in the output color space of the display. For purposes of this discussion, the output image data produced by GMA unit 110 is referred to as mapped image data. In one implementation of GMA unit 110, mapped image data comprises RGBW and L data, as shown in FIG. 5.

With continued reference to FIG. 1, the image data output from GMA unit 110 (or from another image processing front end operation such as an input gamma module), the mapped image data may be input to a subpixel rendering (SPR) unit 130. In particular, if the input image data is specified in a first display format (e.g. RGB stripe, triad, etc.) and the output image data is to be rendered on another, second display format (e.g. one of the many PenTile™ subpixel layouts as disclosed in many of the aforementioned patent applications incorporated by reference), then a mapping must take place between the first and second display formats. Subpixel rendering (SPR) unit 130 includes a combination of hardware and/or software (not shown) suitable for implementing subpixel rendering techniques described in various ones of the above-mentioned U.S. patent application Publications, such as, for example, in US Patent Application Publication Numbers 2003/0103058 (entitled "METHODS AND SYSTEMS FOR SUB-PIXEL RENDERING WITH GAMMA ADJUSTMENT"), 2005/0225562 (entitled "SYSTEMS AND METHODS FOR IMPROVED GAMUT MAPPING FROM ONE IMAGE DATA SET TO ANOTHER"), and 2005/0225563 (entitled "IMPROVED SUBPIXEL RENDERING FILTERS FOR HIGH BRIGHTNESS SUBPIXEL LAYOUTS").

In portion 100 of the conventional display system of FIG. 1, it is typical to employ line memory buffer 120 in order to supply SPR unit 130 with the image data needed to further process the image data. For merely one example, when SPR unit 130 implements an area resampling technique such as disclosed in, for example, the aforementioned US 2003/0103058, 2005/0225562 and 2005/0225563 patent application publications, a key process in subpixel rendering is the sampling, or filtering, operation. The SPR filtering operation typically, but not necessarily, requires nine (9) color values input from three lines of input image (e.g., RGB) data. In software implementations this can be done with one or more intermediate frame buffers. Input values are read into frame buffers in whatever order they arrive, and then the SPR filtering operations randomly access the frame buffers to obtain necessary values. In conventional hardware implementations of SPR processing, at least a portion (e.g., nine (9) values) of three lines of input image (e.g., RGB) data is stored in line buffer memories 120 to do the SPR calculations. Thus, SPR unit 130 may typically employ a 3×3 matrix of image data surrounding a given input image data point in order to perform the area resampling operation to generate ouput data values for particular subpixels on a display panel. In the conventional system illustrated in FIG. 1, one data line carries data passed through GMA 110 and two data lines carry data from the two line buffers 120. For a description of examples of a hardware implementation of a conventional SPR unit 130, see, for example, US 2003/0103058 and US 2005/0225548.

The result of the subpixel rendering operation performed by SPR unit 130 is an output image data set delivered via a data path (not shown) to an electronic display panel (not shown) for producing the resulting image thereon. When SPR unit 130 is included in the same device with an electronic display panel, the data path is included in the electronics in the display panel. Other implementations of the portion 100 of the display system of FIG. 1 may provide for other configurations of the output data path and the display panel upon which the output image is displayed.

The resolution of the display panel upon which the image data is displayed may influence the architecture of the display system illustrated in FIG. 1. For merely exemplary purposes, one embodiment of the system as shown in FIG. 1 is for a display system having a display panel with qVGA (or QVGA, quarter Video Graphics Array, also known as "quarter VGA") resolution of 320×240. A display system architecture for a qVGA display panel might be designed as follows: input image data (e.g., RGB) bit-depth is 18 bits; GMA unit 110 output bit-depth is 50 bits; one line memory size is 320×50 bits=16000 bits; and thus, the total of the two lines of memory is 32000 bits. In FIG. 1, the line buffer size is increased because the internal processing of data inside block 100 is 10 bits/channel, and GMA unit 110 outputs five channels of data to SPR unit 130, as shown in FIG. 5. This line buffer size of 32000 bits may be larger than desired, and it may be desirable to design a system architecture in which the line buffer size is reduced.

Note that it will be appreciated that the dimensioning numbers (e.g. 320×50 bit, etc.) in FIG. 1 and in all other Figures herein are merely representative of one possible embodiment and is not limited to any specific examples or bit depths shown. Additionally, it will be appreciated that the illustrated embodiments are merely exemplary; the general techniques described and shown extend to many other possible embodiments.

First Embodiment of a Display System Architecture

Figure 2:
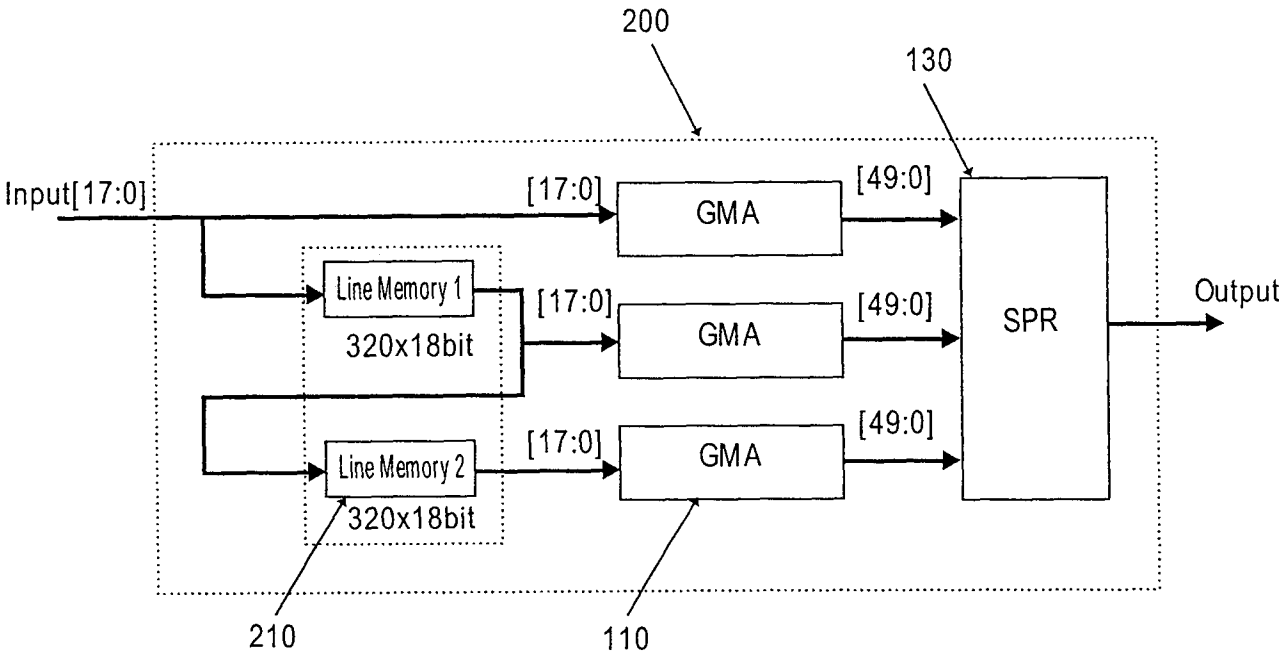
FIG. 2 is a simplified block diagram of the portion of the image processing system or image display system of FIG. 1 illustrating one embodiment of an improved memory structure.

FIG. 2 is a simplified block diagram of a portion 200 of the functional components of a display system that also performs subpixel rendering of an input image data set for an electronic display panel substantially comprised of a plurality of a subpixel repeating group of the type disclosed in US 2005/0225574 and 20050225575, and in other ones of the patents and patent application publications referenced above. FIG. 2 illustrates a first embodiment of an improved memory structure for the display system of FIG. 1. In the portion 200 of the system illustrated in FIG. 2, the one GMA unit 110 of FIG. 1 is replaced with several separate GMA units 110 that each perform the functions of GMA unit 110 of FIG. 1.

In addition, in the architecture illustrated in FIG. 2, two line buffers 210 are placed in the data path between the input image data circuitry and the several GMA modules 110. When implementing the gamut mapping operation represented in FIG. 5, each GMA block processes input image data from real time or from data stored in the line buffers 210, and outputs 50 bit mapped image data to SPR unit 130. FIG. 2 illustrates three GMA units 110 in order to produce three channels of input to SPR unit 130. As noted above, SPR block 130 typically processes image data in blocks of data represented in a 3×3 matrix. When this type of subpixel rendering operation is implemented in SPR unit 130, then three channels of input image data are required.

In one implementation for example, the 10 bit red data from each GMA block 110 are compared and processed in SPR unit 130 to produce the output red data values for the red subpixels of the display panel. Additionally, data from the other color channels may be used for an image sharpening operation, as discussed, for example, in US 2005/0225563, and in others of the patent application publications herein incorporated by reference. Green, Blue, and White data may be processed in a similar manner.

In the example shown in FIG. 2, the line buffers store input image data at 6 bits/pixel, and thus the size needed for each line buffer 210 is reduced to 320×18 bits=5760 bits, or a total of 11,520 bits for the two line buffers. This is a large reduction in memory requirements compared to the conventional system illustrated in FIG. 1, which needed 32,000 bits of memory. In the embodiment illustrated in FIG. 2, three separate GMA units 110 are utilized, as compared to the one GMA unit utilized in the conventional embodiment of FIG. 1. If the size of each GMA unit 110 is small, then the total silicon area needed to implement the gamut mapping operations of GMA units 110 and the subpixel rendering operation of SPR unit 130 may be reduced as a result of the reduction in the size of line buffer memory 210. That is, the reduction in the size of line buffer memory 210 more than offsets the additional two GMA units 110 in total silicon area.

Second and Third Embodiment of a Display System Architecture

Figure 3:
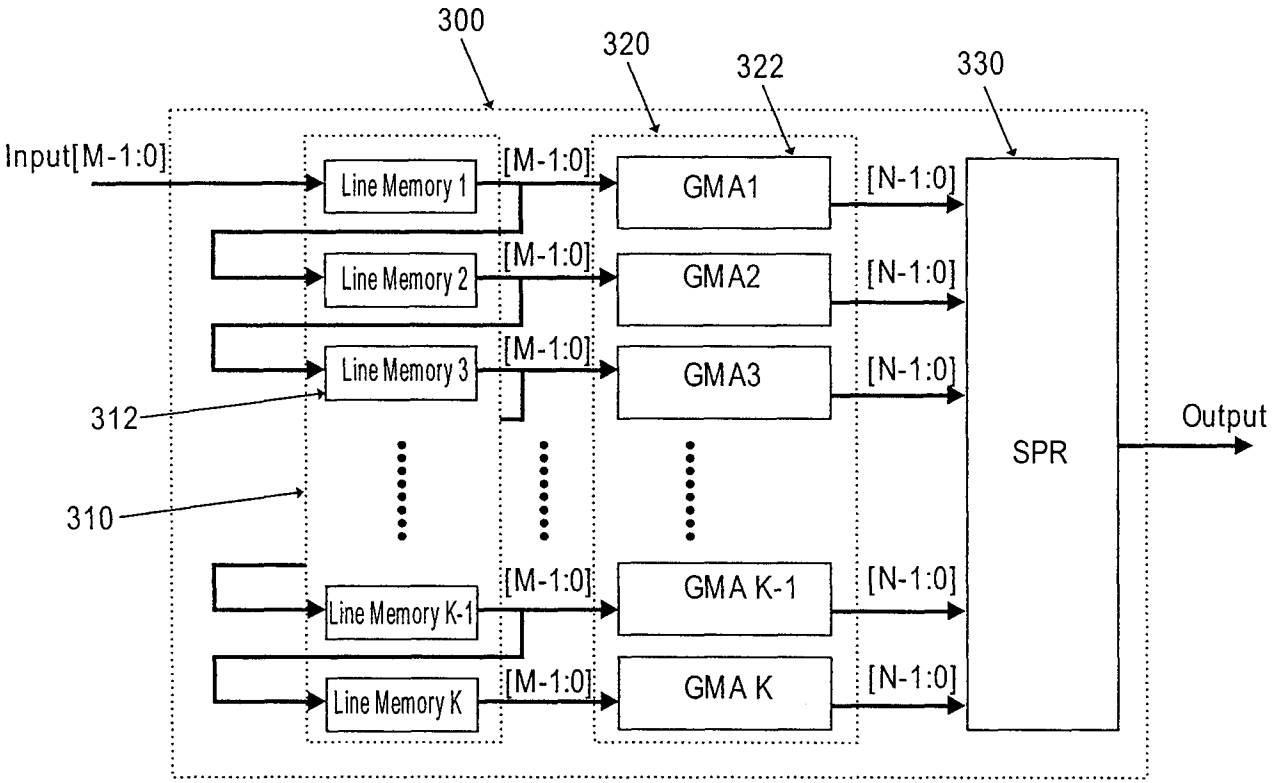
FIG. 3 is a simplified block diagram of the portion of the image processing system or image display system of FIG. 1 illustrating a second embodiment of an improved memory structure.

FIG. 3 is a simplified block diagram of a portion 300 of the functional components of a display system that also performs subpixel rendering of an input image data set for an electronic display panel substantially comprised of a plurality of a subpixel repeating group of the type disclosed in US 2005/0225574 and 20050225575, and in other ones of the patents and patent application publications referenced above. FIG. 3 illustrates a second embodiment of an improved memory structure for the display system of FIG. 1. In the portion 300 of the system illustrated in FIG. 3, SPR unit 330 represents the more general case of a subpixel rendering operation that uses SPR filters in which K lines of image data are processed simultaneously, where K is an integer greater than 3. For example, if the SPR filter is a 5×5 matrix or 4×5 matrix, then K=5. Source (input) data depth is generally M bits where M=three times the bit depth of each color. For example for 8 bits/color, M is equal to 24.

Input image data is input into a cascade 310 of line buffers 312 and a cascade 320 of GMA units 322. In this embodiment, one line buffer memory 312 is used for each input image data line to be processed. After an input image data line is processed by a GMA unit 322, and depending on the bit depth internal to GMA unit 322, the mapped image data output from each GMA unit 322 proceeds to SPR unit 330 in parallel as shown in FIG. 3. The bit depth of the mapped image data from each GMA unit 322 is shown in FIG. 3 as (N−1:0), and depends on the number of data values generated by GMA unit 322. For example, if the internal bit depth used for processing in each GMA unit 322 is 11 bits/color, and GMA unit 322 outputs 5 channels of data (e.g., RGBW and L, as described below with reference to FIG. 5), then N=54 and the data is output from each GMA unit 322 on 55 lines (54:0). After SPR block 330 subpixel renders the mapped image data, the output image data is converted to 8 bits/color for each of red, green, blue, and white.

Figure 4:
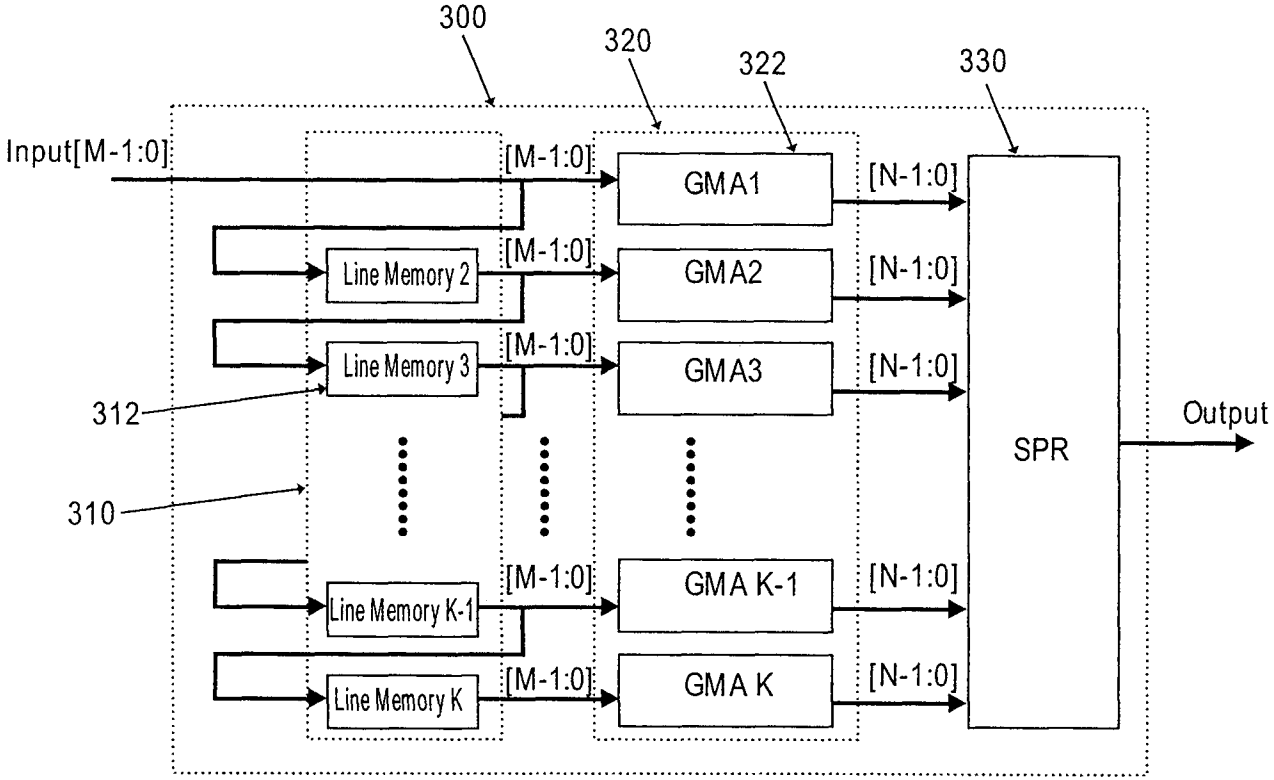
FIG. 4 is a simplified block diagram of the portion of the image processing system or image display system of FIG. 3 illustrating a third embodiment of an improved memory structure.

FIG. 4 is a simplified block diagram of a portion 300 of the functional components of the display system of FIG. 3 illustrating a variation of the embodiment of FIG. 3 in which line buffer memory 1 is removed. In the embodiment illustrated in FIG. 4, "real time" input image data is used as the first line of input image data input to the first GMA unit 322. This is similar to the embodiment illustrated in FIG. 2. Image processing in FIG. 4 otherwise proceeds in the same manner as described above with respect to the embodiment illustrated in FIG. 3.

Figure 7:
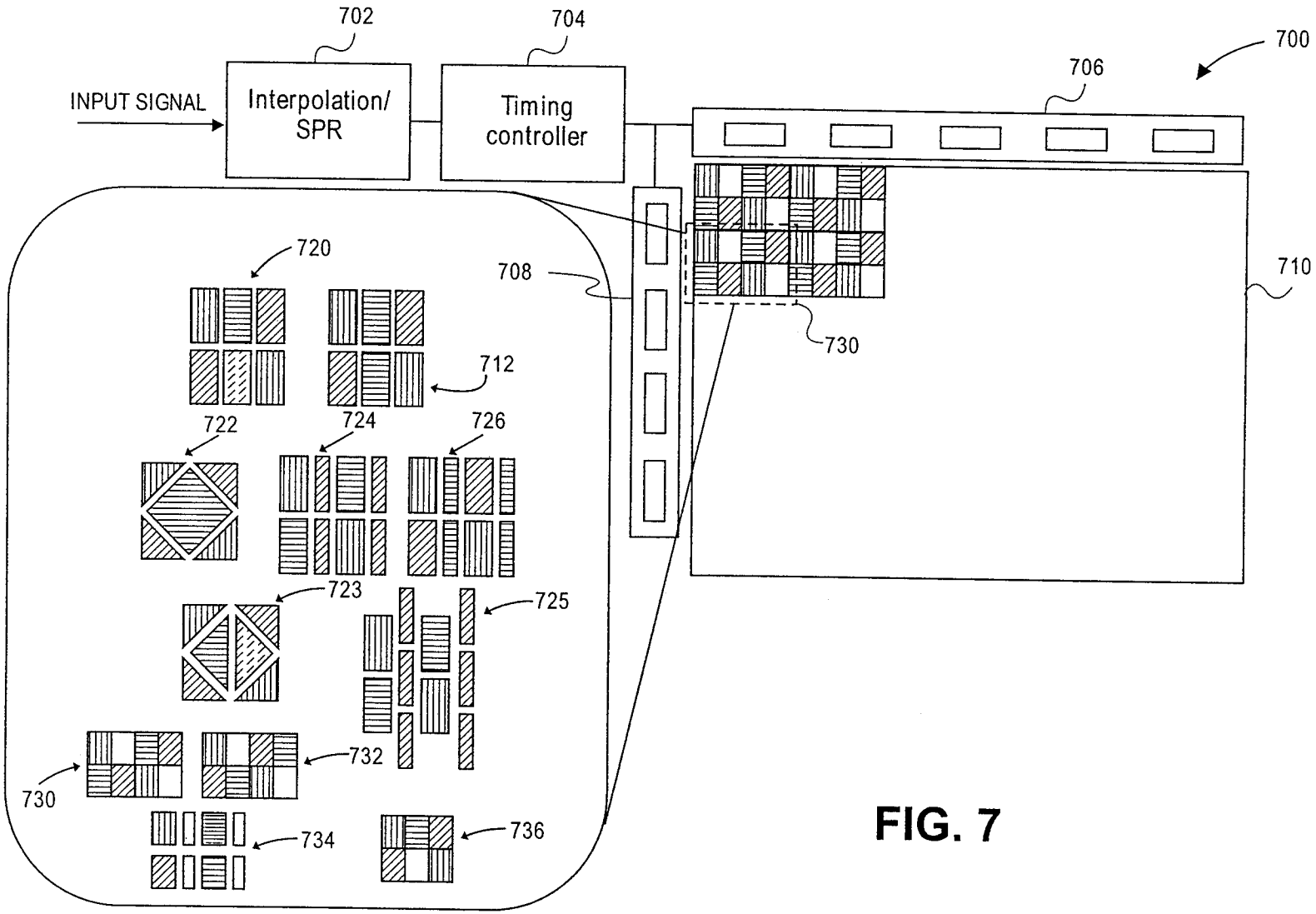
FIG. 7 is a simplified block diagram of an image processing system or image display system that may implement any one of the embodiments of the memory structures illustrated in FIGS. 2, 3 and 4.

FIG. 7 is a general block diagram of display system 700 comprising an interpolation/SPR module 702, a timing controller 704 and column and row drivers 706 and 708 respectively which provide image signals to display panel 710. Display system 700 is an example of a display system that may be used to implement any one of the display architectures shown in FIGS. 2, 3 and 4. Display panel 710 may substantially comprise any one of the subpixel repeating groups 720, 712, 722, 724, 726, 723, 725, 730, 732, 734 and 736. Different hatching of the subpixels denotes different colors—for example, subpixels having vertical hatching are red, subpixels having horizontal hatching are blue, and subpixels having diagonal hatching are green. Partial diagonal hatching, closer horizontal hatching, or no hatching at all denotes another fourth color—e.g. cyan, magenta, white (or no filter) or yellow.

By way of example, display panel 710 is shown as substantially comprising subpixel repeating group 730, which is an eight subpixel repeating group disposed in two rows and having the sequence RWBG in the first row, and BGRW in the second row. Display panel 710 may also substantially comprise a subpixel repeating group having the sequence of RGBW subpixels in a first row, and BWRG subpixels in a second row. The particular subpixel repeating groups shown in FIG. 7 are not intended to limit display system 700 in any way, and those of skill in the art will appreciate that other subpixel repeating groups and other display system architectures are contemplated as being within the scope of the appended claims. Display system 700 may be built from many possible manufacturing technologies, including but not limited to LCD, OLED, PDP and many others.

Alternative GMA-to-SPR Architecture

FIG. 5 is a simplified block diagram illustrating a conventional hardware implementation of a multiprimary GMA unit 110. In the embodiment illustrated in FIG. 5, GMA unit 110 maps input RGB image data to the RGBW color space. A person of skill in the art will appreciate that the same principles would apply for a mapping from any three-primary-color input image color space to any multiprimary color space. In the conventional implementation illustrated in FIG. 5, GMA unit 110 outputs 5 data values: the four primary color data values R, G, B and W of the output display, and an L data value which indicates a luminance or luminosity value derived during the gamut mapping operation. An implementation of SPR module 130 may use the L values for subpixel rendering, as previously described in several patent application publications incorporated by reference above. In this system, line buffer memory 502 is sufficiently large enough to store the data arriving from GMA unit 110, including the L value, or any other value derived or derivable from the color primaries. These data values are, in turn, supplied to SPR unit 130 for further processing.

Figure 6:
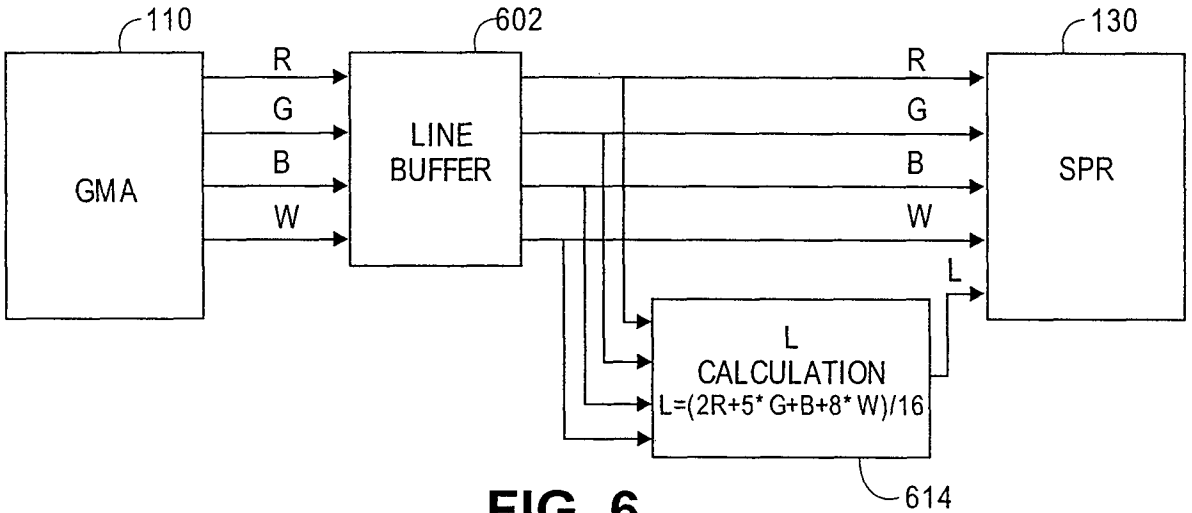
FIG. 6 is a simplified block diagram of the portion of the image processing system or image display system of FIG. 1 illustrating an embodiment of an improved memory structure for the portion of the image processing system shown in FIG. 5.

FIG. 6 is another simplified block diagram illustrating a conventional hardware implementation of a multiprimary GMA unit 110 which illustrates one embodiment of an improved memory structure that may use derived or derivable values. As illustrated in the embodiment shown in FIG. 5, GMA unit 110 in FIG. 6 also outputs data values for the four primary color data values R, G, B and W of the output display. Line buffer 602 takes in image data representing only the primary color image data and stores no derived values. As these primary color values are further piped to SPR unit 130, the RGBW data are sent to a calculation unit 614 as well, in order to derive the data value needed by SPR unit 130. In this example, the derived value is the luminance L value and may be calculated in any manner known, including according to the calculation shown in block 614. The formula shown is for the special case where the luminance to be ascribed to the white subpixel equals the sum of the luminance from the red, green and blue color data values. Note that if the white luminance is to be derived differently, then the formula shown in calculation unit 614 would be modified accordingly.

While the above illustrated embodiments have been described in connection with particular functional units, operations or hardware, the description is not intended to limit a particular implementation, and it will be understood by those skilled in the art that these functional units and operations can be implemented using any combination of hardware and/or software. For example, a programmable gate array or like circuitry can be configured to implement such functional blocks. In other examples, a microprocessor operating a program in memory can also implement such functional blocks. Thus, while the techniques and implementations have been described with reference to exemplary embodiments, it will be understood by those skilled in the art that various changes may be made and equivalents may be substituted for elements thereof without departing from the scope of the appended claims. In addition, many modifications may be made to adapt a particular situation or material to the teachings without departing from the essential scope thereof. Therefore, the particular embodiments, implementations and techniques disclosed herein, some of which indicate the best mode contemplated for carrying out these embodiments, implementations and techniques, are not intended to limit the scope of the appended claims.

What is claimed is:

1. A display system comprising:

a plurality of line buffer memories, each said line buffer memory configured to store input image data specified in a first color space, a plurality of gamut mapping modules, said gamut mapping modules configured to accept said input image data from said plurality of line buffer memories and to perform a gamut mapping of said input image data to a second color space; and a subpixel rendering module for performing subpixel rendering on said mapped image data of said second color space.

2. The display system of claim 1 wherein said subpixel rendering module is configured to perform subpixel rendering using at least a portion of K lines of input image data, where K is an integer greater than one; and said plurality of gamut mapping modules comprises K gamut mapping modules; each gamut mapping module configured to perform a gamut mapping of at least a portion of one line of input image to said second color space.

3. The display system of claim 2 wherein said plurality of line buffer memory comprises K line buffer memories; each line buffer memory configured to provide at least a portion of one line of said input image data to each gamut mapping module.

4. The display system of claim 2 wherein said plurality of line buffer memories comprises K−1 line buffer memories; each line buffer memory configured to provide at least a portion of one line of said input image data to each of K−1 gamut mapping modules; and one of said K gamut mapping modules is arranged to accept said input image data directly from input image circuitry without storing said input image data in a line buffer memory.

5. The display system of claim 4 wherein said display system further includes a display panel; and wherein each of said K−1 line buffer memory is configured to store one complete line of said input image data such that a size of each line buffer memory equals an effective resolution of said display panel in a row direction.

6. The display system of claim 2 wherein K equals three; and wherein said plurality of gamut mapping modules comprises three gamut mapping modules.

7. The display system of claim 2 wherein K is greater than three; and wherein said plurality of gamut mapping modules comprises more than three gamut mapping modules.

8. The display system of claim 2 wherein a value of K depends on a size of an area resampling filter used by said subpixel rendering module when performing said subpixel.

9. The display system of claim 1 further including a display panel substantially comprising a subpixel repeating group; said subpixel repeating group comprising subpixels in at least three primary colors defining said second color space.

10. The display system of claim 9 wherein said subpixel repeating group comprises subpixels in red, green, blue and white primary colors.

11. The display system of claim 10 wherein said subpixel repeating group comprises eight subpixels disposed in two rows of subpixels according to the sequence

R G B W

B W R G.

12. A display system comprising:

a display panel substantially comprising a subpixel repeating group; said subpixel repeating group comprising subpixels having at least four primary colors;

input circuitry for receiving input image data specified in a first color space;

a plurality of K−1 line buffer memories, where K is an integer greater than one; each of said K−1 line buffer memories storing at least a portion of one line of said input image data;

a plurality of K gamut mapping units; each of K−1 gamut mapping units being configured to accept at least a portion of one of K−1 lines of said input image data from at least one of said plurality of line buffer memories; one of said K gamut mapping modules being configured to accept at least a portion of one of K−1 lines of said input image data directly from said input circuitry; said plurality of K gamut mapping units being configured to perform a gamut mapping operation to convert said input image data specified in said first color space into K lines of mapped image data specified in a second color space defined by said at least four primary colors; and a subpixel rendering unit configured to accept said K lines of mapped image data specified in said second color space from said plurality of gamut mapping units; said subpixel rendering unit performing a subpixel rendering operation on said K lines of mapped image data to produce image data values for said subpixels of said display panel.

13. The display system of claim 12 wherein K equals three; and wherein said plurality of gamut mapping modules comprises three gamut mapping modules.

14. The display system of claim 12 wherein K is greater than three; and wherein said plurality of gamut mapping modules comprises more than three gamut mapping modules.

15. The display system of claim 12 wherein said subpixel repeating group comprises subpixels in red, green, blue and white primary colors.

16. The display system of claim 15 wherein said subpixel repeating group comprises eight subpixels disposed in two rows of subpixels according to the sequence

R G B W

B W R G.

17. The display system of claim 12 wherein each of said K−1 line buffer memory is configured to store one complete line of said input image data such that a size of each line buffer memory equals an effective resolution of said display panel in a row direction.

18. The display system of claim 12 wherein a value of K depends on a size of an area resampling filter used by said subpixel rendering unit when performing said subpixel rendering operation to produce image data values for said subpixels of said display panel.

19. An image processing method for rendering an image onto a display panel substantially comprising a subpixel repeating group; the method comprising:

receiving input image data specified in a first color space and indicating a portion of said image;

storing said input image data in a plurality of line buffer memories;

in a plurality of gamut mapping units configured to receive said input image data from the plurality of line buffer memories, performing a gamut mapping operation using said input image data stored in said plurality of line buffer memories to produce mapped image data indicating image data values in a second color space; and performing a subpixel rendering operation using said mapped image data to produce subpixel data values for rendering said portion of said image on said display panel.

20. The image processing method of claim 19 wherein performing said subpixel rendering operation comprises using one of an n×K filter, K×n filter, and K×K filter, where K is an integer greater than one; and performing said gamut mapping operation using said input image data stored in said plurality of line buffer memories comprises performing said gamut mapping operation using a plurality of K gamut mapping modules.

21. The image processing method of claim 19 wherein storing said input image data in a plurality of line buffer memories comprises storing at least a portion of each of K lines of input image data in K line buffer memories.

* * * * *